United States Patent [19]

McCabe, Jr. et al.

[11] 4,077,310

[45] Mar. 7, 1978

[54] AIR CONDITIONING TERMINAL ASSEMBLY

[75] Inventors: Frank J. McCabe, Jr., Tyler, Tex.; Milton H. Coleman, East Syracuse; Carl C. Herb, Camillus, both of N.Y.

[73] Assignee: Carrier Corporation, Syracuse, N.Y.

[21] Appl. No.: 766,324

[22] Filed: Feb. 7, 1977

Related U.S. Application Data

[63] Continuation of Ser. No. 447,603, Mar. 4, 1974, abandoned.

[51] Int. Cl.[2] ..... F24F 13/08

[52] U.S. Cl. ..... 98/40 D; 236/49

[58] Field of Search ..... 98/40 D, 40 R, 40 B, 98/114, 40 N; 236/49; 251/153; 138/108; 239/552, 590

[56] References Cited

U.S. PATENT DOCUMENTS

| | | | |
|---|---|---|---|
| 3,420,439 | 1/1969 | Meckler | 98/40 DL |
| 3,554,111 | 1/1971 | Traver | 98/40 D |
| 3,730,071 | 5/1973 | Gutheim et al. | 98/40 D |
| 3,837,267 | 9/1974 | Lambert | 98/40 D |
| 3,980,007 | 9/1976 | Herb | 98/40 D |

*Primary Examiner*—William F. O'Dea
*Assistant Examiner*—Henry C. Yuen
*Attorney, Agent, or Firm*—J. Raymond Curtin; Barry E. Deutsch

[57] ABSTRACT

An assembly for use in a terminal in an air conditioning system, the assembly including first and second spaced apart members. A third member is interposed between the first and second members. The first and third members define therebetween a first air passage. The second and third members define therebetween a second air passage. The first, second and third members are joined together to form an integral assembly.

1 Claim, 5 Drawing Figures

AIR CONDITIONING TERMINAL ASSEMBLY

This is a continuation of application Ser. No. 447,603 filed Mar. 4, 1974, now abandoned.

BACKGROUND OF THE INVENTION

This invention relates to air terminals employed in air conditioning systems, and more particularly, to an assembly for use in such terminals.

The utilization of air conditioning systems employing terminals to provide conditioned air from a central source thereof to a plurality of areas or spaces in an enclosure, such as offices in office buildings, has become quite extensive. Generally, such areas have what is known as "false" ceilings. "False" ceilings may comprise a plurality of tiles which are suitably suspended below the actual ceiling of the space having the conditioned air introduced thereinto. The tiles are provided to improve the aesthetic appearance of the space, and in addition, may improve the acoustical characteristics of such space. Terminals, including both supply and return, as well as the other components of the air conditioning system are generally installed in the space, so the lower surfaces of the terminals are substantially flush with the lower surface of the "false" ceiling.

Supply air terminals employed in systems of the type described above may include means to regulate the volume of air discharged into any one area in accordance with the temperature thereof. Such terminals are particularly important in applications wherein it is desired to minimize operating costs, since only the volume of conditioned air required to meet the actual demands of an area is supplied by units serving such space.

As noted before, systems of the type hereinabove described utilize both supply air and return air terminals. As used herein, the term "terminal", unless otherwise specifically modified, shall encompass both supply air and return air units. To meet the aesthetic requirements of architects and building owners, the return air terminal and supply air terminal should appear identical when viewed from the floor of the area being served. To minimize the costs of manufacturing and thus installing systems employing such terminals, it is highly desirable that components and/or assemblies employed in a supply air terminal should also be suitable for use in a return air terminal.

A supply air terminal of the type described is illustrated in U.S. Pat. No. 3,554,111, issued Jan. 12, 1971. A return air unit of the type described is disclosed in U.S. Pat. No. 3,657,901. The two aforecited patents and the present application are assigned to a common assignee.

Although the supply and return terminals described in the cited patents appear identical when viewed by the occupant of the space served thereby, each of the terminals requires its own components.

SUMMARY OF THE INVENTION

It is therefor an object of this invention to provide an assembly for use in terminals of air conditioning systems.

It is a further object of this invention to provide an assembly that may satisfactorily be employed either in a supply air terminal or in a return air terminal of an air conditioning system.

These and other objects of the present invention are obtained by providing an assembly comprising a first member and a second member spaced apart therefrom. A third member is interposed between the first and second members. The first and third members define therebetween a first air passage and the second and third members define therebetween a second air passage. The first, second and third members are interconnected via joining means to form an integral assembly.

DESCRIPTION OF THE PREFERRED EMBODIMENT

Figure 1:
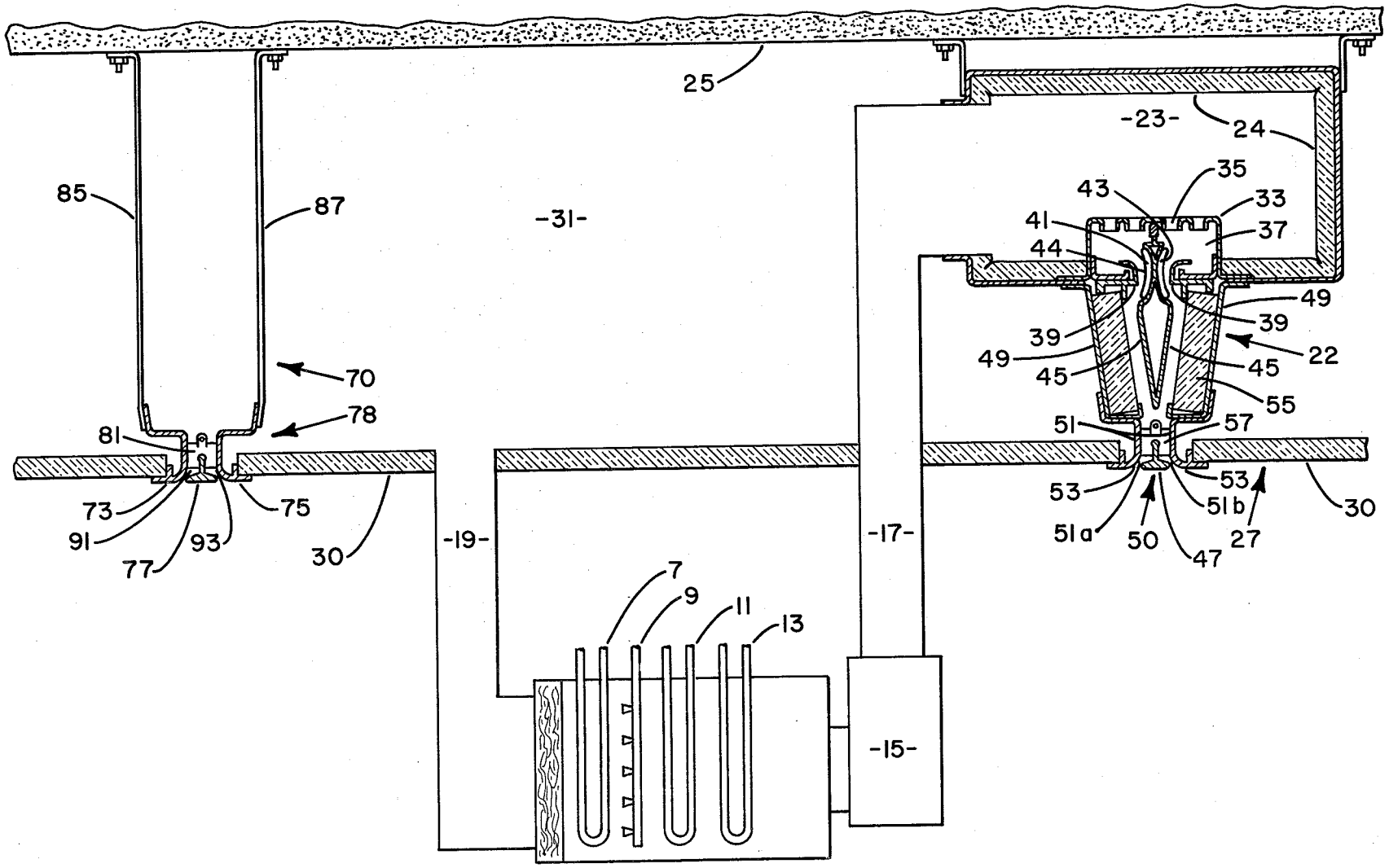
FIG. 1 of the drawing is a schematic view, partially in section of an air conditioning system employing the present invention.

Referring to the drawings, there is illustrated an air conditioning system suitable for providing conditioned air simultaneously to a plurality of separate areas in a common enclosure. The system includes a central source for providing the conditioned air. The central source includes precooling coil 7, spray means 9, cooling coil 11, heating coil 13, and a fan 15 for heating, cooling, and humidifying the air as is desired to provide conditioned air for passage to the separate areas being served by the system.

Supply air duct 17 is illustrative of a plurality of ducts provided to supply conditioned air to air terminals located throughout the enclosure. Return air duct 19 is illustrative of a plurality of ducts provided throughout the enclosure to return air from the various spaces to the central source for reconditioning. Supply air duct 17 communicates with at least one supply air plenum 23 of a supply terminal 22. Plenum 23 is preferably suitably lined with a sound absorbing material such as a glass fiber blanket 24.

As shown in FIG. 1, supply air plenum 23 is disposed in a space defined between actual ceiling 25 and "false" ceiling 27, the false ceiling being preferably formed by suitable acoustical tile 30.

The space formed between false ceiling 27 and actual ceiling 25 serves as a return air plenum 31. Return duct 19 communicates with return air plenum 31.

Figure 2:
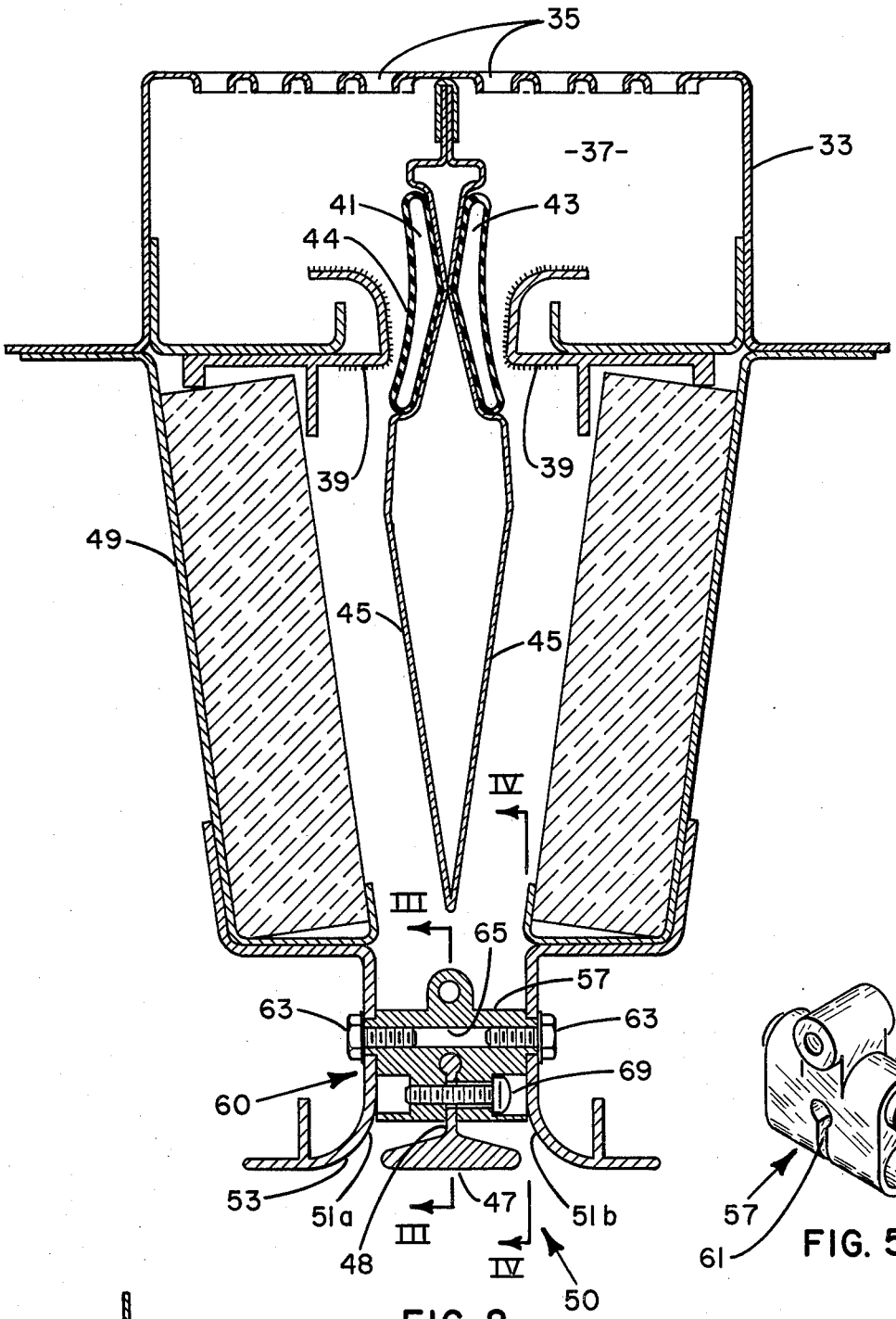
FIG. 2 is a sectional view of a supply air terminal including the present invention.

As shown in FIGS. 1 and 2, an air supply distribution plate 33, having a plurality of collared openings 35, is provided to evenly distribute supply air from supply plenum 23 into distribution chamber 37, chamber 37 being defined by the top and side walls of distribution plate 33.

The bottom of distribution chamber 37 includes aligned cutoff plates 39. The plates cooperate with selectively inflatable bladders 41 to 43 to form a damper. Bladders 41 and 43, when fully inflated, typically form a pear-shape configuration. Bladders 41 and 43 are adhesively mounted on a central partition assembly comprised of opposed generally convex plates 45. The plates have a V-shaped recess therein so the bladders are completely recessed within the plates when they are deflated. This provides a large area between the active walls 44 of the bladders and the cutoff plates for maximum air flow therebetween. Further, the recess bladder provides a smooth surface along the plate 45 to minimize air turbulence. Walls 44 of the bladders are normally concave. Therefore, when the bladders are fully deflated, the active walls of the bladders are out of the air stream to minimize the possibility of bladder flutter. By recessing the bladders within plates 45, and providing the bladders with concave wall 44, the distance between the cutoff plates and the walls 44 of the bladders is increased. This provides a greater opening between a bladder and the cutoff plate when the bladder is fully deflated for maximum air flow therebetween. Further, it is large movement of wall 44, from a concave to a convex position may be obtained without stretching the bladder material.

The bladders and cutoff plates comprise a damper mechanism which is disposed a substantial distance upstream from the discharge openings in the terminal to thereby provide sufficient space therebetween to absorb any noise generated by the damper mechanism. For maximum sound absorption, downwardly extending walls 49, which form air passages in conjunction with plates 45, are lined with a sound absorbing material such as a glass fiber blanket 55. Supply air terminal 22 includes a diffuser section 50 comprising outlet members 51 having outwardly flared lower portions 53. Outlet members 51 are preferably affixed to walls 49 by suitable means, as for example welding. The diffuser section of the terminal further includes diffuser member 47 which is preferably of triangular configuration. Diffuser member 47 is interposed between the spaced apart outlet members 51.

The opposed surfaces of diffuser member 47 and outlet member 51*a* define therebetween a first air passage, functioning in supply air terminal 22 as a conditioned air supply passage. Similarly, the opposed surfaces of diffuser member 47 and outlet member 51*b* define therebetween a second conditioned air supply passage. Outlet members 51 and diffuser member 47 are joined together by means 57 to be more fully described hereinafter, to form an integral assembly 60.

Figure 5:
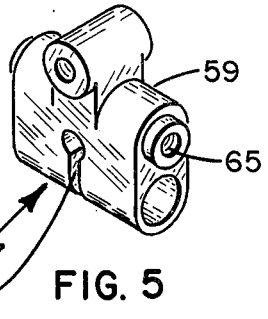
FIG. 5 is a perspective view of a detail of the invention.
Figure 3:
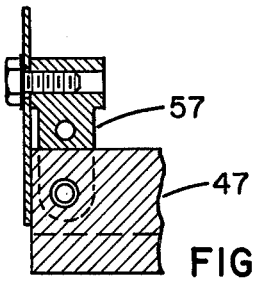
FIG. 3 is a sectional view taken along line III—III of FIG. 2.
Figure 4:
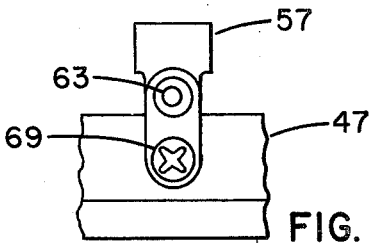
FIG. 4 is a sectional view taken along line IV—IV of FIG. 2.

As is best illustrated in FIG. 5, joining means 57 preferably has a body portion 59 having a slot 61 formed therein. Slot 61 is provided to receive an upstanding leg 48 of diffuser member 47. Joining means 57 is of a predetermined width. Accordingly, when the joining means is placed between the opposed surfaces of outlet members 51, the space therebetween can be accurately and evenly maintained. By maintaining the width of the space at a predetermined dimension, proper air distribution is obtained.

Bolts 63 are threadibly received within hole 65 of joining means 57 to thereby connect the joining means to outlet members 51. Similarly, bolt 69 is provided to secure upstanding leg 48 of diffuser member 47 within slot 61 of joining means.

In order to reduce the cost of manufacturing and installing terminals of the type described hereinabove, a reduction in the number of elements employed in manufacturing the terminals, without reducing the performance capabilities thereof, is greatly desired.

With particular reference to FIG. 1, diffuser assembly 60 hereinbefore described with reference to supply terminal 22, is additionally illustrated as defining a return air terminal.

As noted hereinbefore, for aesthetic purposes, it is desirable that the terminals look identical, when viewed by an occupant of the space or area served thereby. Accordingly, assume return air terminal 70 and supply air terminal 22 are disposed in the same space. Return air terminal comprises spaced apart members 73 and 75, these members being identical to outlet members 51 hereinbefore described. Interposed between members 73 and 75 is a third member 77. Member 77 is identical to diffuser member 47 described hereinbefore. Joining means, such as member 81 connect members 73, 75 and 77 to form an integral assembly 78. The assembly functions as a return air unit. Supports 85 and 87 connect the unit to ceiling 25 of the space.

The opposed surfaces of member 73 and 77 define therebetween a first passage 91 for return air to flow from the space through the terminal to return air plenum 31. The opposed surfaces of members 75 and 77 define a second air passage 93 for the flow of return air through the terminal.

Thus, the assemblies comprising members 47 and 51, and members 73, 75 and 77 may be interchangeably employed in either a supply air terminal to define a diffuser section thereof, or to define a return air terminal. The reduction in cost thus obtained does not produce any deterioration in the operating performance of the system.

While a preferred embodiment of the present invention has been described and illustrated, the invention should not be limited thereto, but may be otherwise embodied within the scope of the following claims.

We claim:

1. An assembly for use in an air conditioning system having supply air terminals comprising vertically extending plate members mounting inflatable bellows operable to regulate the flow of air from said terminal and return air terminals, said assembly being suitable for use in said return air terminal and in said supply air terminal, said assembly comprising:

a first member having an outwardly flared lower portion and an upstanding leg projecting upwardly from said lower portion;

a second member spaced apart from said first member and having an outwardly flared lower portion and an upstanding leg projecting upwardly from said lower portion;

a third member interposed between said first and second members, and having a generally upstanding leg spaced from said upstanding legs of said first and second members, said first and third members defining a first air passage therebetween and said second and third members defining a second air passage therebetween, said first and second passages adapted to direct air downwardly therethrough when said assembly is employed in a supply air terminal, and said passages adapted to direct air upwardly therethrough when said assembly is employed in a return air terminal; and a single unitary joining member interconnecting said first, second and third members to form an integral assembly, said joining member including a pair of opposed faces and a body portion having an axially extending slot disposed midway between said opposed faces, said upstanding leg of said third member being disposed within said slot, said opposed faces being in intimate contact with the opposed surfaces of said first and second members, said joining member being in vertical alignment with and spaced below said generally vertically extending plate members when said assembly is employed in said supply air terminal.

* * * * *